United States Patent [19]

Kitamura et al.

[11] Patent Number: 4,798,748

[45] Date of Patent: Jan. 17, 1989

[54] ARTIFICIAL FUR

[75] Inventors: Hiroshi Kitamura, Kusatsu; Seiichi Yamagata, Otsu, both of Japan

[73] Assignee: Toray Industries, Inc., Tokyo, Japan

[21] Appl. No.: 917,590

[22] Filed: Oct. 10, 1986

[30] Foreign Application Priority Data

Oct. 25, 1985 [JP] Japan ..... 60-237478
Oct. 25, 1985 [JP] Japan ..... 60-237479

[51] Int. Cl.[4] ..... A41D 5/00

[52] U.S. Cl. ..... 428/15; 428/89; 428/92

[58] Field of Search ..... 428/17, 89, 90, 92, 428/95, 15, 16

[56] References Cited

U.S. PATENT DOCUMENTS

| | | | |
|---|---|---|---|
| 3,961,882 | 6/1976 | Vits et al. | 8/924 X |
| 4,390,572 | 6/1983 | Okamoto et al. | 428/92 X |
| 4,415,611 | 11/1983 | Yamagata et al. | 428/92 X |
| 4,525,404 | 6/1985 | Matsui et al. | 428/92 |
| 4,546,020 | 10/1985 | Sakai et al. | 428/92 X |
| 4,574,018 | 3/1986 | Masuda et al. | 428/90 X |
| 4,576,840 | 3/1986 | Murata et al. | 428/16 |
| 4,613,529 | 9/1986 | Yamashita et al. | 428/92 X |

*Primary Examiner*—Henry F. Epstein
*Attorney, Agent, or Firm*—Armstrong, Nikaido, Marmelstein & Kubovcik

[57] ABSTRACT

Disclosed is artificial fur which comprises an erect pile layer consisting of a number of erect fibers in different colors which are substantially complementary with one another, the fibers being arranged adjacent to one another in the erect pile layer.

20 Claims, 3 Drawing Sheets

ARTIFICIAL FUR

BACKGROUND

This invention relates to a novel artificial fur. More particularly, it relates to an elegant artificial fur having an iridescence.

There have been frequently attempted to obtain artificial furs made to imitate natural furs.

A high-grade natural fur has an erect pile structure wherein a number of erect piles of a certain length grow thickly to give a characteristic voluminousness. It is this erect pile structure that imparts an impression of high-gradeness and a fine appearance to a coat or jacket made of a fur as mentioned above, since the erect pile layer shows a delicate and clear change in a shade and gloss of color as the one wearing it moves or as wind blows. Further soft fluttering and rustling of the numerous erect piles brings about a dynamic change in its appearance.

On the other hand, natural furs, in particular mink furs, which are highly evaluated and very popular among natural furs, show various colors including black, dark brown, pale brown and grayish white. In these natural furs, erect piles forming the outer part of the erect pile layer are dark while those in the inner part of the same, which becomes visible as the wearer moves as mentioned above, are in a similar tone to the former but more pale or lighter. This relationship between the colors of the erect piles results in a delicate change in the shade and gloss of the whole appearance.

Further there are natural furs obtained by dyeing white natural furs or bleaching, in general, low-grade ones to give an apparently natural color, e.g., black, or a vivid color which is never observed in nature. However the tone as well as the strength of the color of the outer part of the erect pile layer of such a fur product are the same as those of the inner part thereof. Thus these products are inferior in the elegance to the above-mentioned high-grade natural furs and less commercially appreciated than them.

Thus conventional fur-type fabrics can not completely imitate natural furs, although various means and dyeing treatments have been attempted therefor.

We have studied on the correlationship among the colors of the erect pile layer which gives the finest appearance to an artificial fur and consequently found that the delicate correlationship among the colors of the erect fibers forming the erect pile layer largely affect the impression of high-gradeness, which is brought about by the whole appearance and aesthetic value of the product, thus completing the present invention.

SUMMARY

It is an object of the present invention to provide a novel and valuable artificial fur which has a fine appearance different from those of high-grade minks and a significantly high aesthetic value. It is another object of the present invention to provide an artificial fur having an obvious iridescence wherein bristles can be distinguished from wooly hairs and each part of the fur can show a clear change depending on the direction or angle or as the one wearing the same moves. Further it is another object of the present invention to provide an artificial fur excellent in the color depth and gloss which has a high aesthetic value and an impression of high-gradeness.

In order to achieve the objects as mentioned above, the present invention provides an artificial fur comprising an erect pile layer consisting of a number of erect fibers, wherein the erect fibers in different colors, which are substantially complementary with each other, are adjacent to each other in said erect pile layer.

THE DRAWINGS

THE PREFERRED EMBODIMENTS

Figure 13:
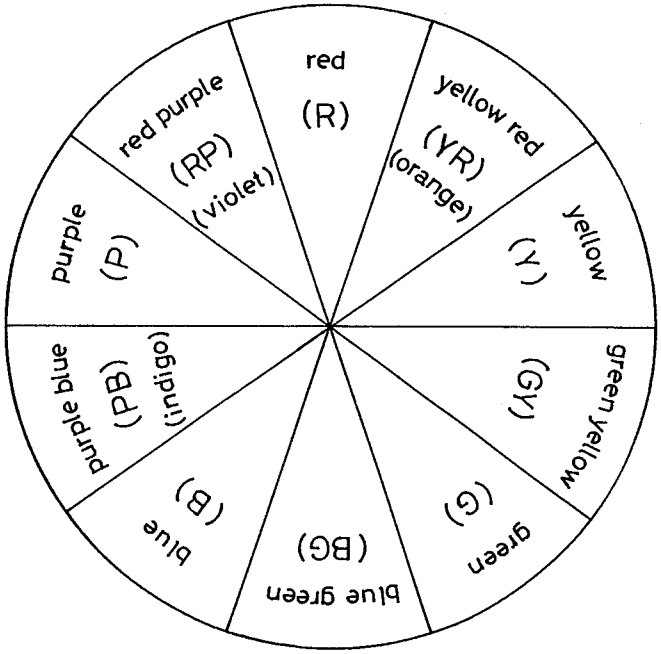
FIG. 13 is a color circle showing the complementary relationship as defined in JIS-Z-8102.

The expression "substantially complementary" as used herein means a relationship between a particular color with not only the one present at the opposite position thereto in the "complementary color circle" as specified in JIS-Z-8102 (cf. FIG. 13) but also the two colors adjacent to the latter. The complimentary relationship of the colors of the complimentary color circle is illustrated by the colors on a color circle, as viewed clockwise; yellow, green yellow, green, blue green, blue, purple blue (indigo), purple, red purple, red, yellow red. When the particular color is, for example, "yellow", the complementary colors include "purple blue" opposite thereto as well as "blue" and "purple" adjacent to the latter.

When erect fibers in these colors substantially complementary with each other are arranged in such a manner as to be adjacent to each other in an erect pile layer, the artificial fur comprising said erect pile layer shows different colors depending on the direction, i.e., so-called iridescence.

Figure 1A:
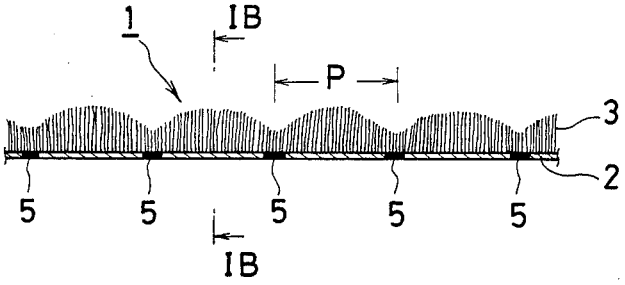
FIG. 1A is a sectional view of the artificial fur of an Example of the present invention taken vertical to the hair.
Figure 1B:
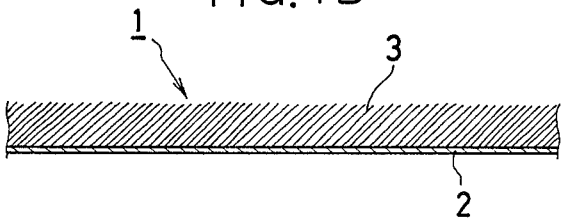
FIG. 1B is a sectional view taken along line IB—IB of FIG. 1A.
Figure 2:
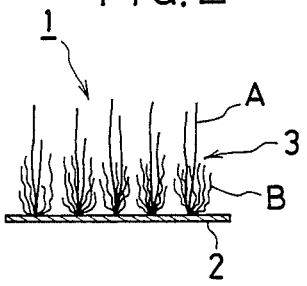
FIG. 2 is an enlarged schematic illustration of erect piles of FIG. 1A.

In the present invention, the erect pile layer comprising erect fibers in the substantially complementary colors as described above is formed by closely filling a number of erect fibers 3 on a base fabric 2 as shown in FIGS. 1A and 1B. It is preferable that these erect fibers 3 forms a structure consisting of two or more erect pile layers of long fibers A and short fibers B (cf. FIGS. 2 and 3). However the erect pile layer may consist of a single layer of either the long fibers A or the short fibers B. Namely, an erect pile layer structure may be of a single layer of fibers which are substantially the same in length.

Figure 5:
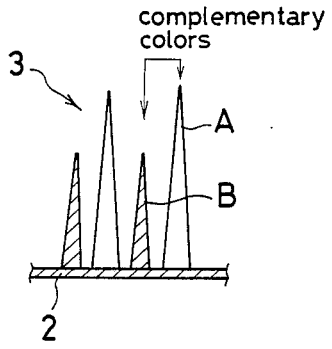
FIGS. 5 to 12 are model views each shows erect piles of an embodiment.
Figure 6:
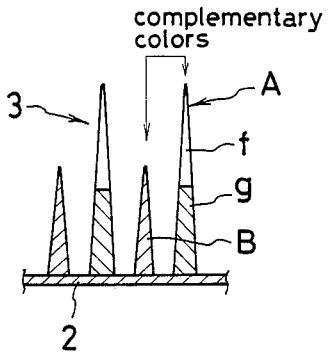

In the erect pile layer as described above, the color of the long fibers A is substantially complementary with that of the short fibers B as shown in FIG. 5. Alternately the tip (f) of each long fiber A may be in a color which is different from that of the other part (g) thereof and complementary with that of the short fibers B.

The substantially complementary relationship may be established among the colors of the numerous long fibers A. In addition, it is further preferable that one of the colors of the long fibers A is complementary with that of the short fiber B. Alternately the substantially complementary relationship may be established among the colors of the numerous short fibers B. In addition, it is further preferable that one of the colors of the short fibers B is complementary with that of the long fiber A.

Figure 7:
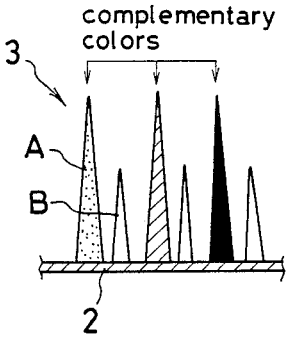
Figure 8:
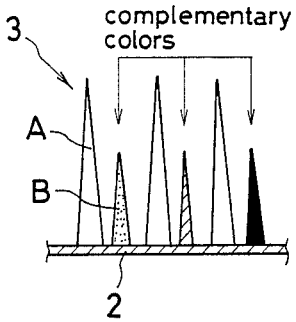

Alternately the tips (f) of some long fibers A may be in a color which is different from that of the other part (g) thereof and complementary therewith. In this case, the tips of other long fibers may be further in a color which is different from that of the other part thereof and complementary with the color of the tips (f) of the former long fibers as shown in FIG. 7. Similarly the tips of some short fibers (h) may be in a color different from that of the other part (i) thereof and complementary therewith. In this case, it is further preferable that the tips of other short fibers is in a color different from that of the other part thereof and complementary with the color of the tips (h) of the former short fibers as shown in FIG. 8.

Figure 11:
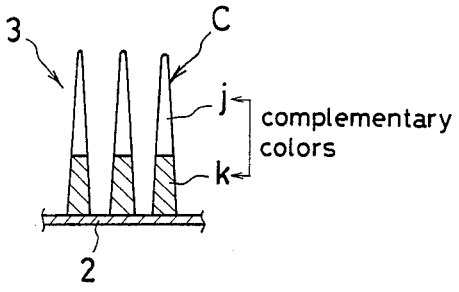
Figure 12:
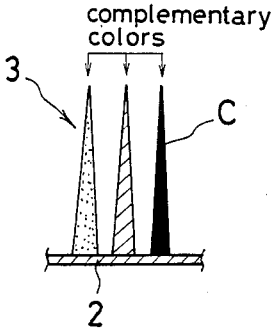

The above examples illustrate erect pile layers wherein the erect fibers 3 consist of the erect pile layers of long fibers A and those of short fibers B. The same complementary relationship as the one described above may be applied to erect fibers consisting of fibers which are substantially the same in length (cf. FIGS. 11 and 12). Namely the tips (j) of the fibers C are dyed with a color which is different from that of the other part (k) thereof and substantially complementary therewith (cf. FIG. 11). Alternately the whole of each fiber C may be dyed with a single color which is substantially complementary with those of the adjacent fibers.

An erect pile layer which consists of a mixture of erect fibers in two or more colors complementary with each other, as the one described above, shows different colors depending on the direction to give a so-called iridescence. This phenomenon becomes more obvious with an increase in the number of the employed colors which are complementary with each other.

It is further preferable that the erect pile layer consists of two or more layers comprising long fibers and short fibers respectively and that the lightness (L value) of the short fibers is lower by at least 0.5, more desirably by at least 2.5, than that of the long fibers to impart an excellent color depth and an impression of high-gradeness to the product.

The correlationship among the lightnesses of the both fibers gives an appearance wherein the erect pile consisting of the long fibers more sufficiently covers that of the short fibers, which brings about an iridescence as well as an excellent color depth and an impression of high-gradeness.

The lightness (L value) as described above may be determined with a color difference meter such as a Hunter's direct-reading photoelectric color difference meter as specified in JIS-Z-8722 or a digital colorimetric color difference computer AUD-SCH-2 (mfd. by Suga Test Instrument Co., Ltd.).

This L value is expressed by a figure of 0 to 100. The larger value represents the higher lightness, i.e., the lighter color. Therefore the L value of black is almost 0 while that of white is almost 100. In the present invention, the L values of the long and short fibers are independently determined after dyeing these fibers. Each value may be determined in the form of a raw cotton prior to the production of an artificial fur. Alternately it may be determined after forming an artificial fur and separating the erect pile layer of the same into the long and short fibers.

Figure 9:
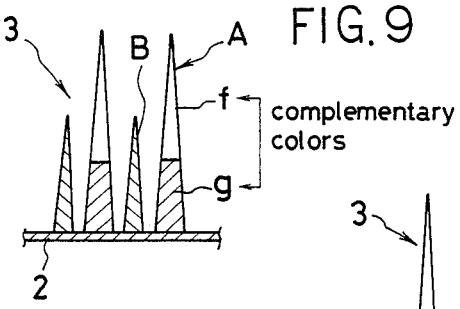
Figure 10:
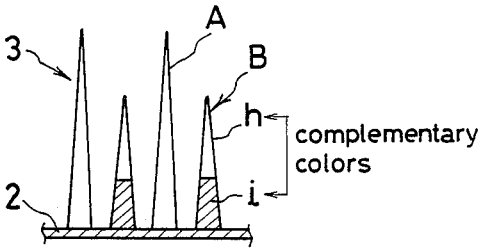

Further in the case of an erect pile layer wherein the tips (f) of long fibers A are in a color which is different from that of the other part (g) of the same and complementary therewith (cf. FIG. 9), an impression of colorfulness and voluminousness can be obtained and the iridescence can be further emphasized by making the short fibres B substantially achromatic and of a lower lightness than that of the tips (f) of the long fibers A.

The expression "substantially achromatic" as used herein includes not only white, gray and black colors but also somewhat bluish or reddish gray and black colors. The degree of these colors may be expressed by figures according to the "L, a, b" color specification with the use of a color difference meter. Thus the expression "substantially achromatic" as used herein means those showing a and b values of within $\pm$ 4, i.e., having absolute values of 4 or below when subjected to colorimetry with the use of a c light source which is an artificial natural light.

In addition, the larger figure in the positive region of the a value denotes a more reddish color while the larger figure in the negative region thereof denotes a more greenish color. On the other hand, the larger figure in the positive region of the b value denotes a more yellowish color while the larger figure in the negative region thereof denotes a more bluish color. In the present invention, it is preferable that the absolute a and b values of the short fibers are as small as possible and, as a matter of course, smaller than 4.

The tips of erect fibers and the other part thereof may be readily dyed in a color and another one substantially complementary therewith as mentioned above respectively by the following piece-dyeing, yarn-dyeing and yarn/piece-dyeing.

(1) Piece-dyeing

A fabric comprising an erect pile layer is formed from fibers of a definite length. It is immersed in a dyeing solution, drained and dried. Then a dyeing solution in a color substantially complementary with the one of the former was applied on the tips of the erect pile layer of this fabric by printing followed by drying and color development.

(2) Yarn-dyeing (a) Two dyeing solutions whose colors are substantially complementary with each other are respectively applied on the center and the both tips of fibers of a definite length. Then these fibers are dried followed by color development.

(b) A bundle of previously dyed fibers is formed and a dyeing solution in a color substantially complementary with that of said fibers is applied on the both tips thereof followed by color development. Alternately the bundle is subjected to color development as it is immersed in said dyeing solution.

(c) A dyeing solution is applied on an undyed fiber bundle and then subjected to color development as it is immersed in another dyeing solution in a color substantially complementary with that of the former.

(3) Yarn/piece-dyeing

A fabric comprising an erect pile layer is formed from previously dyed fibers. Then a dyeing solution in a color substantially complementary with that of the former is applied on the tips of the erect pile layer by printing followed by drying and color development.

Figure 3:
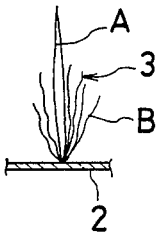
FIG. 3 is a model view of the same erect piles as those described above.

In the artificial fur of the present invention, a number of erect fibers 3 stand aslant with respect to a base fabric 2 along the hair to thereby form an erect pile structure (cf. FIG. 1B). Thus it is desirable that the erect pile layer forms ridges along the hair in the section vertical to the hair as shown in FIG. 1A, i.e., a multiridge structure, in order to improve the voluminousness of the artificial fur. As shown in FIG. 1A, a number of erect fibers 3 different from each other in length are arranged on a ridge in such a manner that the longer erect fiber is located the more close at the center of the width P of the ridge to thereby form a protruded erect pile layer. Namely, the variation in the length of the erect fibers contributes to emphasize the impression of voluminousness of the product. In order to further emphasize this impression, the width P of each ridge is preferably within a range of 3 to 10 cm. The erect fibers 3, which are shown in detail in an enlarged view of FIG. 2, preferably has a two-layer structure comprising long fibers A and short fibers B. FIG. 3 is a model view of the long fibers A and short fibers B in an erect fiber 3.

The long fibres A as mentioned herein correspond to bristles of a fur having a two-layer structure and are generally longer and thicker than wooly hairs. Bristles generally cover wooly hairs, form the external appearance of a fur and impart the texture of the same. Preferable bristles are strong and highly elastic and have an appropriate thickness. Namely, it is desirable to employ fibers having a single fiber fineness of 5 to 60 deniers, preferably 20 to 50 deniers, and an average fiber length of 10 to 70 mm, preferably 20 to 60 mm.

On the other hand, the short fibers B correspond to wooly hairs of a fur having a two-layer structure and are shorter than the bristles. They exhibit effects of protecting the erectness and elasticity of the bristles and of keeping out the cold. These short fibers generally have a single fiber fineness of 0.1 to 5 deniers, preferably 1 to 3 deniers and an average fiber length of 5 to 50 mm, preferably 10 to 40 mm.

The long fibers A are longer than the short fibers B by several millimeters or above, preferably by 5 mm or above.

Examples of fibers available for the bristles and wooly hairs as mentioned above are synthetic fibers such as polyester, polyamide and polyacryl; regenerated fibers such as rayon and cuprammonium rayon; semisynthetic fibers such as acetate; natural fibers such as cotton, linen and wool and mixtures thereof.

In the artificial fur of the present invention, it is preferable that the tip of each erect pile consisting of long fibers A and short fibers B is sharpened in order to further improve the texture, touch and appearance of the same. This improving effect may be achieved at least by sharpening the tips of the bristle erect piles. However, the touch and texture of the product are furthermore improved by sharpening the tips of the wooly hair erect piles too.

Therefore polyester synthetic fibers such as polyethylene terephthalate and polybutylene terephthalate among the fibers as cited above are preferable for these erect piles since they can be readily sharpened and are highly elastic.

When bristles made of synthetic fibers are used in the present invention, the synthetic fibers are preferably subjected to a thermal treatment after spinning and drafting and in a straight form without any crimp. Highly preferable bristles having excellent straightness of erect piles, an excellent appearance and soft touch may be obtained by further sharpening such straight fibers as mentioned above. On the other hand, it is preferable that the wooly hairs show low crimping, i.e., having a crimp ratio of approximately 13% or below and the number of crimps of approximately 16 per inch.

Figure 4A:
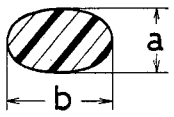
FIG. 4A is a transverse sectional view of an erect fiber.
Figure 4B:
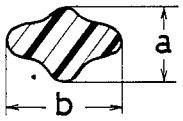
FIG. 4B is a transverse sectional view of an erect fiber of another embodiment of the present invention.

Each long fiber forming the bristle erect piles in the present invention preferably has a flat section of a flatness of 1.5 or above. Such flat fibers may bring about desirable bristle erect piles without enhancing the roughness nor the ratio thereof. The flat section as described herein denotes an ellipse as shown in FIG. 4A or a flat crosssection as shown in FIG. 4B. The flatness is expressed in the major/minor axes ratio and represented by b/a in FIGS. 4A and 4B.

The erect piles may be formed by, for example, blending filaments or staples of the long and short fibers each dyed in the abovementioned manner at an appropriate weight ratio and flocking a fabric, a knit or a nonwoven fabric therewith; knitting the same into a pile fabric; knitting the same with a sliver knitter; or fabricating the same into a double-layered fabric and then cutting the pile yarns connecting the two layers with a knife to thereby form a pile fabric. Namely, processes disclosed in Japanese Patent Laid-Open No. 61739/1982 and No. 167434/1982 are preferably employed.

The long fibers and the short fibers may be blended in a ratio of 10 to 90/90 to 10, preferably 35 to 65/65 to 35.

The fur-type product thus obtained may be further subjected to some post-treatment such as backing, raising or brushing, if required.

As described above, the artificial fur of the present invention, which has an erect pile layer wherein a number of erect fibers in colors substantially complementary with each other are adjacent to each other, shows different colors depending on the direction, i.e., giving a so-called iridescence. Further the erect pile layer consists of bristles, i.e., long fibers, and wooly hairs, i.e., short fibers, and the lightness of the latter is lower by at least 0.5 than that of the former, which brings about an impression of high-gradeness excellent in the color depth and gloss to the artificial fur.

EXAMPLE 1

Sharpening of long fibers for bristles:

Three staples were prepared by cutting a polybutylene terephthalate filament of 40 deniers having an elliptic cross-section of 2.0 in flatness as shown in FIG. 4A to 35 mm, 33 mm and 29 mm. Each staple was formed into a fiber bundle of 4 cm in diameter and covered therearound with paper. The obtained paper-enclosed fiber bundle was immersed in a 40% solution of caustic soda and treated at 105° C for 60 minutes. Then it was thoroughly washed with water to thereby remove decomposition products. The fibers thus obtained had sharpened tips and fiber lengths thereof were 29 mm, 27 mm and 23 mm, respectively.

Dyeing of long fibers for bristles:

The staples sharpened in the above manner were dyed at 120° C. for 60 minutes with the following formulation with a high-pressure paddle dyeing machine:

| | |
|---|---|
| Palanil Yellow 3G (disperse dye; mfd. by BASF); | 0.42% o.w.f.; |
| Resolin Blue BBLS (disperse dye; mfd. by Bayer); | 0.34% o.w.f.; |
| Ionet TD-208 (leveling agent; mfd. by Sanyo Chemical Industries, Ltd.); and | 0.5 g/l |
| Fixer PH-500 (pH adjustor; mfd. by Sanyo Chemical Industries, Ltd.); | 0.5 g/l |

-continued

| | |
|---|---|
| bath ratio: 1:30. | |

After dyeing, each staple was subjected to reductive washing in a well-known manner, washed with hot water and then with cold water, and dried.

1 g of each staple, which was thus dyed green, was introduced into a cell of 35 mm in diameter and 5 mm in depth of a digital colorimetric color difference computer AUD-SCH-2 (mfd. by Suga Test Instrument Co., Ltd.) and the lightness (L) thereof was determined. Table 1 shows the result.

Dyeing of short fibers for wooly hairs:

Three polyethylene terephthalate staples of two deniers in fineness and different lengths (2 d×20 mm, 2 d×18 mm and 2 d×16 mm) were prepared. Each staple was given a low crimp, i.e., 3.8% in crimp ratio and 7.0 per inch in crimp number. These staples were dyed with the following formulation at 130° C for 60 minutes with a package dyeing machine:

| | |
|---|---|
| Resolin Blue BBLS | 0.3% o.w.f.; |
| Kayalon Polyester Rubine BLS 200% (disperse dye; mfd. by Nippon Kayaku Co., Ltd.); | 2.25% o.w.f.; |
| Ionet TD-208 | 0.5 g/l; and |
| Fixer PH-500 | 0.5 g/l; |
| bath ratio: 1:7. | |

The lightness (L) of each staple, which was thus dyed reddish purple, was determined in the same manner as described in (2). Table 1 shows the result. Production of fur-type fabric:

A fur-type pile fabric was produced from pile yarns obtained by mixed spinning of the long fibers for bristles and the short fibers for wooly hairs each obtained in the abovementioned manner. Prior to weaving, the following three pile yarns E, F and G were prepared:

pile yarn (E): mixed spinning of long fibers for bristles of 40 d×29 mm (green) with short fibers for wooly hairs of 2 d×20 mm (reddish purple);

pile yarn (F): mixed spinning of long fibers for bristles of 40 d×27 mm [the same color as that of the bristles of pile yarn (E)]with short fibers for wooly hairs of 2 d×18 mm [the same color as that of the wooly hairs of pile arn (E)]; and pile yarn (G): mixed spinning of long fibers for bristles of 40 d×23 mm [the same color as that of the bristles of pile yarn (E)]with short fibers for wooly hairs of 2 d×16 mm [the same color as that of the wooly hairs of pile yarn (E)].

The blending ratio of the long fibers for the bristles to the short fibers for the wooly hairs of each pile yarn was 40/60% by weight.

In the weaving of the above pile fabric, the pile yarns were arranged in the following manner to thereby obtain the multiridge structure wherein each ridge comprised a gentle dome-type erect pile as shown in FIG. 1A. Namely, the pile yarn (E) formed the central erect pile portion of 7 mm in width. In each side of this central portion, an erect pile portion of a mixture of the pile yarns (E) and (F), that of the pile yarn (F), that of a mixture of the pile yarns (F) and (G) and that of the pile yarn (G), each 7 mm in width, were located to thereby give a total ridge width of 63 mm.

Long polyethylene terephthalate fibers were employed as the homespun warps forming the base structure. Pale brown terephthalate threads were employed as the warps of the main base structure while dark brown polyethylene terephthalate threads were employed at each boundary of 6 mm in width between ridges.

After weaving, the gray fabric was back-coated with a polyurethane resin and erect piles on the surface of the gray fabric were unfolded and loosened to thereby give a pile fabric. The obtained pile fabric was in a multiridge structure wherein ridges of gentle dome erect piles having a ridge pitch of 6.3 cm were repeated along the direction of the width, as shown in FIG. 1A. On the back of the pile fabric, dark brown base structures 5 of 6 mm in width were striped on the pale brown main base structure.

The artificial fur thus obtained had bristles in a green color and wooly hairs in a reddish purple color substantially complementary with the former. Table 1 suggests that the lightness of the latter is lower by 5.6 than tha of the former. Each color was clearly distinguishable from the other in the two-layer structure of the bristles and wooly hairs. And the green bristles could be clearly observed among the reddish purple wooly hairs, which brought about a definite appearance which was excellent in the color depth and gloss and highly voluminous. Further the artificial fur showed each color independently or the mixture thereof depending on the direction, i.e., having an iridescence which made the product highly valuable from an aesthetic viewpoint.

EXAMPLE 2

Dyeing of long fibers for bristles:

The same bristle staples as those used in Example 1 were dyed with the following formulation under the same condition as the one described in Example 1:

| | |
|---|---|
| Resolin Blue BBLS | 0.03% o.w.f.; |
| Terasil Orange 5RL 150% (mfd. by Chiba-Geigy); and | 0.24% o.w.f. |
| Kayalon Polyester Rubine BLS 200% | 0.88% o.w.f. |

The lightness (L) of each staple, which was thus dyed red, was determined in the same manner as the one described in Example 1. Table 1 shows the result. Dyeing of short fibers for wooly hairs:

The same staples for wooly hairs as those used in Example 1 were dyed with the following formulation under the same condition as the one described in Example 1:

| | |
|---|---|
| Resolin Blue BBLS | 2.4% o.w.f.; and |
| Palanil Yellow 3G | 3.0% o.w.f. |

The lightness (L) of each staple, which was thus dyed green, was determined. Table 1 shows the result.

Production of fur-type fabric:

A fur-type pile fabric was produced from these dyed staples as obtained above in the same manner as the one described in Example 1.

The artificial fur thus obtained had red bristles and green wooly hairs. The former color is adjacent to the opposite color of the latter as shown in the color circle of FIG. 13. Thus they are substantially complementary with each other. Table 1 suggests that the lightness of the bristles is higher than that of the wooly hairs by 5.5. Therefore each color of the two-layer structure of the bristle and wooly hair layers was clearly distinguishable from the other. The red bristles could be clearly observed among the green wooly hairs, which gave a fine appearance which was excellent in the color depth and gloss and highly voluminous. Similar to the product of Example 1, this artificial fur showed each color independently or the mixture thereof depending on the direction, i.e., having an iridescence.

EXAMPLE 3

Dyeing of long fibers for bristles:

The same staples for bristles as those used in Example 1 were dyed with the following formulation under the same condition as the one described in Example 1.

| | |
|---|---|
| Palanil Yellow 3G | 2% o.w.f.; and |
| Resolin Blue FBL | 2% o.w.f. |

The lightness (L) of each staple, which was thus dyed green, was determined in the same manner as the one described in Example 1. Table 1 shows the result.

Dyeing of short fibers for wooly hairs:

The same staples for wooly hairs as those used in Example 1 were dyed with the following formulation under the same condition as the one described in Example 1.

| | |
|---|---|
| Terasil Orange 5RL 150% | 0.45% o.w.f.; and |
| Kayalon Polyester Rubine 5RL 200 | 1.05% o.w.f. |

The lightness (L) of each staple, which was thus dyed red, was determined in the same manner as the one described in Example 1. Table 1 shows the result.

Production of fur-type fabric:

A fur-type pile fabric was produced from the staples prepared above in the same manner as the one described in Example 1.

The artificial fur thus obtained had green bristles and red wooly hairs. The former color is adjacent to the opposite color of the latter. Thus these colors are substantially complementary with each other. Table 1 suggests that the lightness of the bristles is higher by −1.4 than that of the latter. Therefore the red wooly hairs were somewhat conspicuous in the two-layer structure of the bristle and wooly hair layers. The color depth and gloss of this product were somewhat inferior to those of the Examples 1 and 2. However the artificial fur showed each color independently or the mixtures thereof depending on the direction, i.e., having an iridescence, similar to that of Example 1.

COMPARATIVE EXAMPLE 1

Dyeing of long fibers for bristles:

The same staples for bristles as those used in Example 1 were dyed with the following formulation under the same condition as the one described in Example 1.

| | |
|---|---|
| Dianix Brown 2R-FS (disperse dye; mfd. by Mitsubishi Chemical Industries Ltd.); | 1.25% o.w.f. |
| Dianix Red BN-SE | 0.18% o.w.f.; and |
| Dianix Blue BG-FS | 0.30% o.w.f |

The lightness (L) of each staple, which was thus dyed brown, was determined in the same manner as the one described in Example 1. Table 1 shows the result.

Dyeing of short fibers for wooly hairs:

The same staples for wooly hairs as those used in Example 1 were dyed with the following formulation under the same condition as the one described in Example 1.

| | |
|---|---|
| Resolin Blue BBLS | 3.60% o.w.f.; and |
| Palanil Yellow 3G | 4.50% o.w.f. |

The lightness (L) of each staple, which was thus dyed green, is shown in Table 1.

Production of fur-type fabric:

A fur-type pile fabric was obtained from these dyed staples in the same manner as the one described in Example 1.

Table 1 obviously suggests that the artificial fur thus obtained showed a deep color and gloss but no iridescence since the color of the bristles (brown) was not substantially complementary with that of the wooly hairs (green). Thus the product showed an insufficient impression of high-gradeness.

COMPARATIVE EXAMPLE 2

Long fibers for bristles:

The same red staples for bristles as those used in Example 2 were employed.

Dyeing of short fibers for wooly hairs:

The same staples for wooly hairs as those used in Example 1 were dyed with the following formulation under the same condition as the one described in Example 1:

| | |
|---|---|
| Samaron Black BBL Liquid-150 (disperse dye; mfd. by Hoechst). | 15% o.w.f. |

The lightness (L) of each staple, which was thus dyed black, is shown in Table 1.

Production of fur-type fabric:

A fur-type pile fabric was obtained from these dyed staples in the same manner as the one described in Example 1.

Table 1 obviously suggests that the artificial fur thus obtained was excellent in the color depth and gloss. However it showed no iridescence since the color of the bristles (red) was not substantially complementary with that of the wooly hairs (black). Thus it had an insufficient impression of high-gradeness.

TABLE 1

| | Color combination | | Lightness (L) | | Difference in L (ΔL) | Iridescence* | Appearance** |
|---|---|---|---|---|---|---|---|
| | bristle | wooly hair | bristle | wooly hair | | | |
| Ex. 1 | green | reddish purple | 24.6 | 19.0 | 5.6 | o | o |
| Ex. 2 | red | green | 24.4 | 18.9 | 5.5 | o | o |
| Ex. 3 | green | red | 22.8 | 24.4 | −1.4 | o | x |
| Comp. Ex. 1 | brown | green | 27.5 | 18.9 | 8.6 | x | o |
| Comp | red | black | 24.4 | 15.7 | 8.7 | x | o |

TABLE 1-continued

| | Color combination | | Lightness (L) | | Difference in L (ΔL) | Iridescence* | Appearance** |
|---|---|---|---|---|---|---|---|
| | bristle | wooly hair | bristle | wooly hair | | | |
| Ex. 2 | | | | | | | |

*Iridescence tone:
o: Showing an iridescence.
x: Showing no iridescence.
**Appearance:
o: A deep and glossy appearance wherein wooly hairs are covered with bristles.
x: An appearance poor in the depth and gloss wherein wooly hairs are well observed.

EXAMPLE 4

Dyeing of long fibers for bristles:

The same staples as those used in Example 1 were dyed with the following three formulations A1, A2 and A3 under the same condition as the one described in Example 1:

| | | |
|---|---|---|
| A1: | Palanil Yellow 3G | 1.1% o w.f.; |
| | Resolin Blue FBL | 1.25% o.w.f.; and |
| | Terasil Orange 5RL 150% | 0.45% o.w.f. |
| A2: | Resolin Blue FBL | 2% o.w.f. |
| A3: | Palanil Yellow 3G | 0.9% o.w.f.; |
| | Resolin Blue FBL | 0.1% o.w.f.; and |
| | Terasil Orange 5RL 150% | 0.1% o.w.f. |

These staples were dyed green, blue and yellow with the formulations A1, A2 and A3, respectively. The lightness of a mixture comprising 40% of A1, 40% of A2 and 20% of A3 was 24.1.

Dyeing of short fibers for wooly hairs:

The same staples for wooly hairs as those used in Example 1 were dyed with the following formulation under the same condition as the one described in Example 1:

| | |
|---|---|
| Resolin Blue BBLS | 7.5% o.w.f.; |
| Terasil Orange 5RL 150% | 0.19% o.w.f.; and |
| Kayalon Polyester Rubine BLS 200% | 0.19% o.w.f. |

The lightness (L) of each staple, which was thus dyed blue, was 16.7.

Production of fur-type fabric:

A fur-type pile fabric was produced from pile yarns E, F and G obtained from the three long fibers for bristles (A1, A2 and A3) and the short fibers for wooly hairs each prepared in the abovementioned manner according to the procedure as described in Example 1.

pile yarn (E): mixed spinning of long fibers for bristles of 40 d×29 mm comprising 40% by weight of A1 (green), 40% by weight of A2 (blue) and 20% by weight of A3 (yellow) with short fibers for wooly hairs of 2 d×21 mm (blue);

pile yarn (F): mixed spinning of long fibers for bristles of 40 d×27 mm of the same composition as that of the bristles of pile yarn (E) with short fibers for wooly hairs of 2 d×19 mm [the same color as that of the wooly hairs of pile yarn (E)]; and pile yarn (G): mixed spinning of long fibers for bristles of 40 d×23 mm of the same composition as that of the bristles of pile yarn (E) with short fibers for wooly hairs of 2 d×17 mm [the same color as that of the wooly hairs of pile yarn (E)].

The blending ratio of the long fibers for the bristles to the short fibers for the wooly hairs of each pile yarn was 40/60% by weight.

Among the colors of the bristles of the artificial fur thus obtained, i.e., green (A1), blue (A2) and yellow (A3), blue and yellow are substantially complementary with each other. Thus the product showed an iridescence which gave an impression of high-gradeness and elegance thereto.

In addition, the lightness of the wooly hairs was lower by 7.4 than that of the bristles. Therefore the bristles were conspicuous among the wooly hairs, giving an appearance with depth and gloss.

EXAMPLE 5

Dyeing of long fibers for bristles:

The same staples for bristles as those used in Example 1 were dyed with two formulations A1 and A2 under the same condition as described in Example 1.

| | | |
|---|---|---|
| A1: | Palanil Yellow 3G | 2% o.w.f.; and |
| | Resolin Blue FBL | 2% o.w.f. |
| A2: | Sumikaron Brilliant Red 2-2BL (disperse dye; mfd. by Sumitomo Chemical Co., Ltd.); | 1.0% o.w.f. |
| | Resolin Brilliant Red BS | 1.0% o.w.f. |
| | Kayalon Polyester Light Scarlet GS-200 | 3.4% o.w.f.; and |
| | Foron Rubine S-2GFL (disperse dye; mfd. by Sandoz). | 1.2% o.w.f. |

These staples were dyed bluish green and yellowish red with the formulations A1 and A2, respectively.

The lightness of a mixture of 50% portions of these staples was 25.6.

Dyeing of short fibers for wooly hairs:

The same staples for wooly hairs as those used in Example 1 were dyed with the following formulation under the same condition as the one described in Example 1:

| | |
|---|---|
| Resolin Blue BBLS | 4.0% o.w.f.; |
| Terasil Orange 5RL 150% | 0.1% o.w.f.; and |
| Kayalon Polyester Rubine BLS 200% | 0.1% o.w.f. |

The lightness of each staple, which was thus dyed blue, was 16.7.

Production of fur-type fabric:

A fur-type fabric was produced from the following pile yarns E, F and G obtained by mixed spinning of the two long fibers A1 and A2 for bristles with the short fibers for wooly hairs each obtained above:

pile yarn (E): mixed spinning of long fibers for bristles of 40 d×29 mm comprising 50% by weight of A1 (green) and 50% by weight of A2 (red) with short fibers for wooly hairs of 2 d×20 mm (blue);

pile yarn (F): mixed spinning of long fibers for bristles of 40 d×27 mm of the same composition as that of the bristles of pile yarn (E) with short fibers for wooly hairs of 2 d×18 mm [the same color as that of the wooly hairs of pile yarn (E)]; and pile yarn (G): mixed spinning of long fibers for bristles of 40 d×23 mm of the same composition as that of the bristles of pile yarn (E) with short fibers for wooly hairs [the same color as that of the wooly hairs of pile yarn (E)].

The blending ratio of the long fibers for the bristles to the short fibers for the wooly hairs of each pile yarn was 40/60% by weight.

In the artificial fur thus obtained, the green color of the bristles was substantially complementary with the red color of the same. Further the red color of the bristle was substantially complementary with the blue color of the wooly hair. Thus the obtained product showed different colors depending on the direction, i.e., having an iridescence. In addition, the difference between the lightnesses of the bristle and wooly hairs thereof was 8.7. Therefore the bristles were conspicuous among the wooly hairs, which gave an appearance excellent in color depth and gloss.

EXAMPLE 6

Dyeing of long fibers for bristles:

A fiber bundle of the same staples for bristles as those used in Example 1 was immersed in a dyeing solution of the following formulation I-a and taken out. Then it was completely immersed in a dyeing solution of the following formulation I-b at a bath ratio of 1:5, introduced into a high-pressure steamer as such and subjected to color development at 130° C for 90 minutes therein.

| | |
|---|---|
| Dyeing solution I-a: | |
| Palanil Yellow 3G | 6 g/l; |
| Resolin Blue FBL | 1.3 g/l; |
| Terasil Orange 5RL | 0.6 g/l; and |
| tartaric acid (solid content: 50%) | 0.5 g/l. |
| Dyeing solution I-b: | |
| Palanil Yellow 3G | 18 g/l; |
| Resolin Blue FBL | 4 g/l; |
| Terasil Orange 5RL | 2 g/l; and |
| tartaric acid (solid content: 50%) | 0.5 g/l. |

After the color development, said fiber bundle was washed in a known manner by shaking in a reductive washing bath.

The long fibers for bristles thus dyed were in a dark green color approximately 6 mm from the both tips and in a pale green color at the center.

Dyeing of short fibers for wooly hairs:

The same staples for wooly hairs as those used in Example 1 were dyed with the following formulation under the same condition as the one described in Example 1:

| | |
|---|---|
| Resolin Blue BBLS | 0.3% o.w.f.; and |
| Kayalon Polyester Rubine BLS 200% | 2.25% o.w.f. |

Each staple was thus dyed reddish purple as the whole.

A fur-type fabric, i.e., an artificial fur was produced from the dyed staples for bristles and wooly hairs each prepared in the abovementioned manner. In the artificial fur thus obtained, the color of the tips of the long fibers for bristles was substantially complementary with that of the short fibers for wooly hairs. Thus the product was highly voluminous and showed different colors depending on the direction, i.e., having a so-called iridescence, which imparted an impression of high-gradeness thereto.

EXAMPLE 7

Dyeing of long fibers for bristles:

The same staples as those used in Example 1 were dyed with the following formulation under the same condition as the one described in Example 1:

| | |
|---|---|
| Resolin Blue FBL | 2% o.w.f.; |

The lightness (L) of each staple, which was thus dyed blue, was 23.8.

Dyeing of short fibers for wooly hairs:

The same staples for wooly hairs as those used in Example 1 were dyed with the following two formulations B1 and B2 under the same condition as the one described in Example 1:

| | | |
|---|---|---|
| B1: | Terasil Orange 5RL 150% | 0.78% o.w.f.; and |
| | Kayalon Polyester Rubine BLS 200% | 1.58% o.w.f. |
| B2: | Resolin Blue BBLS | 2.4% o.w.f.; and |
| | Palanil Yellow 3G | 3.0% o.w.f. |

These staples were dyed red and green with the formulations Bl and B2, respectively. The lightness (L) of a mixture of 50% portions of these staples was 20.4.

Production of fur-type fabric:

A fur-type fabric was produced from the following pile yarns E, F and G obtained by mixed spinning of the dyed staples for bristles and those for wooly hairs (Bl and B2) according to the procedure as described in Example 1:

pile yarn (E): mixed spinning of long fibers for bristles of 40 d×29 mm (blue) with short fibers for wooly hairs of 2 d×20 mm comprising 50% by weight of B1 (red) and 50% by weight of B2 (green);

pile yarn (F): mixed spinning of long fibers for bristles of 40 d×27 mm [the same color as that of the bristles of pile yarn (E)]with short fibers for wooly hairs of 2 d×18 mm of the same composition of that of the wooly hairs of pile yarn (E); and pile yarn (G): mixed spinning of long fibers for bristles of 40 d×23 mm [the same color as that of the bristles of pile yarn (E)]with short fibers for wooly hairs of 2 d×16 mm of the same composition as that of the wooly hairs of pile yarn (E).

The blending ratio of the long fibers for the bristles to the short fibers for the wooly hair of each pile yarn was 40/60% by weight.

In the artificial fur thus obtained, the red color of the wooly hairs Bl was substantially complementary with the green color of the wooly hairs B2. Thus the product showed different colors depending on the direction, i.e., having a so-called iridescence. In addition, the lightness of the wooly hairs was lower by 3.4 than that of the bristles. Therefore the blue bristles were conspicuous among the wooly hairs, which gave a deep color and gloss to the product.

EXAMPLE 8

Dyeing of long fibers for bristles:

The same staples for bristles as those used in Example 1 were dyed with the following formulation under the same condition as the one described in Example 1:

| | |
|---|---|
| Palanil Yellow 3G | 0.42% o.w.f.; and |

-continued

| | |
|---|---|
| Resolin Blue BBLS | 0.84% o.w.f. |

The lightness (L) of each staple, which was then dyed bluish green, was 24.6.

Dyeing of short fibers for wooly hairs:

The same staples for wooly hairs as those used in Example 1 were dyed with the following two formulations B1 and B2 under the same condition as the one described in Example 1:

| | | |
|---|---|---|
| B1: | Terasil Orange 5RL 150% | 0.45% o.w.f.; and |
| | Kayalon Polyester Rubine BLS 200% | 1.05% o.w.f. |
| B2: | Resolin Blue BBLS | 6.0% o.w.f.; |
| | Terasil Orange 5RL 150% | 0.15% o.w.f.; and |
| | Kayalon Polyester Rubine BLS 200% | 0.15% o.w.f. |

These staples were dyed red and blue with the formulations Bl and B2, respectively. The lightness (L) of a mixture of 50% portions of these staples was 20.9.

Production of fur-type fabric:

A fur-type fabric was produced from the dyed staples as obtained above in the same manner as the one described in Example 7.

In the artificial fur thus obtained, the bluish green color of the bristles was substantially complementary with the red color of the wooly hairs. Further the two colors of the wooly hairs were substantially complementary with each other. Thus the product had an iridescence. In addition, the difference in the lightnesses of the bristles and the wooly hairs was 3.7. Therefore the bristles were conspicuous among the wooly hairs, which brought about an appearance excellent in color depth and gloss.

EXAMPLE 9

Dyeing of long fibers for bristles:

A bundle of the same staples for bristles as those used in Example 1 was vertically immersed in a dyeing solution of the following formulation I at a bath ratio of 1 : 5 and taken out. Then it was placed horizontally and the dyeing solution attached to the both sides thereof was washed away with water. Subsequently it was vertically and completely immersed in a dyeing solution of the following formulation II at a bath ratio of 1 : 5, introduced into a high-pressure steamer as such and subjected to color development at 130° C for 90 minutes therein:

| | |
|---|---|
| Dyeing solution I: | |
| Dianix Yellow Brown 2R-FS | 108 g/l; |
| Dianix Red BN-SE | 21 g/l; |
| Dianix Blue BG-FS | 1 g/l; and |
| tartaric acid (solid content: 50%) | 0.5 g/l. |
| Dyeing solution II: | |
| Resolin Blue FBL | 40 g/l; and |
| tartaric acid (solid content 50%) | 0.5 g/l. |

The fibers thus dyed were in a blue color 6 mm in average from both tips and in an orange color at the center. The lightness (L) of the both tips, which were cut, was 24.2.

Dyeing of short fibers for wooly hairs:

The same staples for wooly hairs as those used in Example 1 were dyed with the following formulation at 130° C. for 60 minutes.

| | |
|---|---|
| Samaron Black BBL Liquid-150 | 15% o.w.f.; |
| Ionet TD-208 | 0.5 g/lf.; and |
| Fixer PH-500 | 0.5 g/lf.; |
| bath ratio: 1:7. | |

The lightness (L) of each staple, which was thus dyed black, was 15.7.

Production of fur-type fabric:

A fur-type fabric was produced from the following pile yarns E, F and G obtained by mixed spinning of the dyed staples for bristles with wooly hairs each prepared in the abovementioned manner:

pile yarn (E): mixed spinning of long fibers for bristles of 40 d×29 mm in an orange color at the center and a blue color at the both tips with short fibers for wooly hairs of 2 d×20 mm (black);

pile yarn (F): mixed spinning of long fibers for bristles [the same colors as those of the bristles of pile yarn (E)]with short fibers for wooly hairs of 2 d×18 mm [the same color as that of the wooly hairs of pile yarn (E)]; and pile yarn (G): mixed spinning of long fibers for bristles of 40 d×23 mm [the same colors as those of the bristles of pile yarn (E)]with short fibers for wooly hairs of 2 d×16 mm [the same color as that of the wooly hairs of pile yarn (E)].

The blending ratio of the long fibers for bristles to the short fibers for wooly hairs of each staple was 40/60% by weight.

In the artificial fur thus obtained, the blue color at the tips of the long fibers was substantially complementary with the orange color at the other part of the same, which gave an iridescence. Further the short fibers were achromatic, i.e., black and the lightness of the same was lower by 8.5 than that of the bristles, which brought about a high color depth and a glossy tone.

EXAMPLE 10

Dyeing of fibers for erect piles:

A bundle of the same staples for bristles as those used in Example 1 was immersed in a dyeing solution of the following formulation I at a bath ratio of 1:5 and then taken out. Subsequently it was completely immersed in a dyeing solution of the following formulation II at a bath ratio of 1 : 5, introduced into a highpressure steamer as such and subjected to color development at 130° C for 90 minutes as such:

| | |
|---|---|
| Dyeing solution I: | |
| Palanil Yellow 3G | 40 g/l; |
| Resolin Blue FBL | 40 g/l; and |
| tartaric acid (solid content: 50%) | 0.5 g/l. |
| Dyeing solution II: | |
| Resolin Blue BBLS | 6 g/l |
| Kayalon Polyester Rubine BLS 200% | 50 g/l; and |
| tartaric acid (solid content: 50%) | 0.5 g/l. |

The fibers thus dyed were in a reddish purple color at the both tips and a green color at the center.

Production of fur-type fabric:

A fur-type pile fabric was produced from the following pile yarns according to the procedure of Example 1:

pile yarn (E): long fibers for erect piles of 40 d×29 mm;

pile yarn (F): middle fibers for erect piles of 40 d×27 mm; and pile yarn (G): short fibers for erect piles of 40 d×23 mm.

In the artificial fur thus obtained, the tips of the erect piles were reddish purple while the other part thereof was green. These colors were substantially complementary with each other, which brought about an iridescence and an elegant tone. In addition, the reddish purple part looked just like a bristle layer while the green part looked just like a wooly hair layer. Thus the product had a remarkable impression of high-gradeness.

EXAMPLE 11

A fur-type pile fabric was produced from a pile yarn obtained by mixed spinning of 50% portions of the dyed staples Al and A2 for bristles as prepared in Example 5.

In the artificial fur thus obtained, the green color of the erect piles of Al was substantially complementary with the red color of that of A2. Thus the product showed different colors depending on the direction, i.e., having an iridescence.

We claim:

1. An artificial fur having an erect pile layer consisting of a number of erect fibers, wherein erect piles in different colors, which are substantially complementary with each other, are adjacent to each other in said erect pile layer said substantially complementary colored piles are colors which are selected from the group consisting of colors which are opposite each other, and either of the two colors which are adjacent to the opposite color, on a complementary color circle with a complimentary relationship as depicted by a color wheel having the colors, as viewed clockwise; yellow, green yellow, green, blue green, blue, purple blue (indigo), purple, red purple, red, yellow red.

2. An artificial fur as set forth in claim 1, wherein said erect pile layer consists of at least two layers comprising an erect pile layer of long fibers and that of short fibers.

3. An artificial fur as set forth in claim 2, wherein said long fibers are in a color substantially complementary with that of the short fibers.

4. An artificial fur as set forth in claim 2, wherein said long fibers are in colors substantially complementary with each other.

5. An artificial fur as set forth in claim 2, wherein said short fibers are in colors substantially complementary with each other.

6. An artificial fur as set forth in claim 2, wherein at least either of said long fibers or said short fibers are in a color at each tip which is different from that of the other part of the same and substantially complementary with the latter.

7. An artificial fur as set forth in claim 2, wherein the lightness of said short fibers is lower by 0.5 or above than that of the long fibers.

8. An artificial fur as set forth in claim 2, wherein the difference in the lengths of the erect pile layer of said long fibers and that of said short fibers is 5 mm or above.

9. An artificial fur as set forth in claim 2, wherein said long fibers are 10 to 70 mm in length while said short fibers are 5 to 50 mm in length.

10. An artificial fur as set forth in claim 2, wherein said long fibers are thicker than said short fibers and the fineness of the former is 5 to 60 deniers while that of the latter is 0.1 to 5 deniers.

11. An artificial fur as set forth in claim 2, wherein the tips of said long fibers are sharpened.

12. An artificial fur as set forth in claim 2, wherein the tips of said short fibers are sharpened.

13. An artificial fur as set forth in claim 2, wherein the crosssection of each long fiber has a flatness of 1.5 or above.

14. An artificial fur as set forth in claim 1, wherein said erect pile layer consists of a single layer of erect fibers which are substantially the same in length.

15. An artificial fur as set forth in claim 14, wherein the tips of an erect fiber are in a color which is different from that of the other part of the same and substantially complementary with the latter.

16. An artificial fur as set forth in claim 14, wherein erect piles are in colors which are substantially complementary with each other.

17. An artificial fur as set forth in claim 1, wherein said erect pile layer is in a multiridge structure where ridges are substantially along the direction of the fibers.

18. An artificial fur as set forth in claim 1, wherein the width of each ridge of said multiridge erect pile structure is 3 to 10 cm.

19. An artificial fur as set forth in claim 1, wherein said erect fibers are synthetic polyester fibers.

20. An artificial fur as set forth in claim 19, wherein said synthetic polyester fibers are selected from among polyethylene terephthalate and polybutylene terephthalate.

* * * * *